US006876969B2

(12) United States Patent
Nakao

(10) Patent No.: US 6,876,969 B2
(45) Date of Patent: Apr. 5, 2005

(54) DOCUMENT READ-OUT APPARATUS AND METHOD AND STORAGE MEDIUM

(75) Inventor: Makiko Nakao, Inagi (JP)

(73) Assignee: Fujitsu Limited, Kawasaki (JP)

( * ) Notice: Subject to any disclaimer, the term of this patent is extended or adjusted under 35 U.S.C. 154(b) by 666 days.

(21) Appl. No.: 09/768,231

(22) Filed: Jan. 25, 2001

(65) Prior Publication Data

US 2002/0026314 A1 Feb. 28, 2002

(30) Foreign Application Priority Data

Aug. 25, 2000 (JP) ..... 2000-256338

(51) Int. Cl.[7] ..... G10L 21/06
(52) U.S. Cl. ..... 704/260; 704/275; 704/278
(58) Field of Search ..... 704/260, 270, 704/275, 278

(56) References Cited

U.S. PATENT DOCUMENTS 5,386,493 A * 1/1995 Degen et al. ..... 704/267
5,396,577 A * 3/1995 Oikawa et al. ..... 704/260
5,845,248 A 12/1998 Nishida et al.
6,199,076 B1 * 3/2001 Logan et al. ..... 715/501.1

FOREIGN PATENT DOCUMENTS

| | | |
|---|---|---|
| JP | 4-264595 | 9/1992 |
| JP | 7-114537 | 5/1995 |
| JP | 9-44189 | 2/1997 |

* cited by examiner

*Primary Examiner*—Susan McFadden
(74) *Attorney, Agent, or Firm*—Staas & Halsey LLP

(57) ABSTRACT

A document read-out apparatus has a document read-out function for reading out a document according to a first speech parameter. The document read-out apparatus is provided with a first specifying section which specifies a keyword, and a read-out section which reads out the document according to a second speech parameter different from the first speech parameter, until a keyword within the document.

21 Claims, 8 Drawing Sheets

| KEYWORD FOR SPEECH PARAMETER | SPEECH PARAMETER VALUE |
|---|---|
| NORMAL SPEED | 7 |
| MINIMUM SPEED | 0 |
| MAXIMUM SPEED | 9 |
| NORMAL VOLUME | 7 |
| MINIMUM VOLUME | 0 |
| MAXIMUM VOLUME | 9 |
| ETC. | · |
| · | · |
| · | · |
| · | · |

DOCUMENT READ-OUT APPARATUS AND METHOD AND STORAGE MEDIUM

BACKGROUND OF THE INVENTION

This application claims the benefit of a Japanese Patent Application No.2000-256338 filed Aug. 25, 2000, in the Japanese Patent Office, the disclosure of which is hereby incorporated by reference.

1. Field of the Invention

The present invention generally relates to document read-out apparatuses and method and storage media, and more particularly to a document read-out apparatus which has a function of reading out a document, a document read-out method, and a computer-readable storage medium which stores a program for causing a computer to read out a document.

2. Description of the Related Art

Conventionally, various document read-out apparatuses have been proposed to carry out a speech synthesis process with respect to a document so as to read out the document. The document which is read out, may be a document which is input to a word processor or the like, a document which is stored in a recording medium such as a floppy disk or, a document corresponding to a text or the like of an electronic mail, for example.

The conventional document read-out apparatus is capable of carrying out a fast-forward operation and a rewind operation. When carrying out the fast-forward operation, the user makes manual operations to temporarily stop reading out the document, make a fast-forward to a specified position of the document, and start reading out the document again from the specified position. On the other hand, when carrying out the rewind operation, the user makes manual operations to temporarily stop reading out the document, make a rewind to a specified position of the document, and start reading out the document again from the specified position.

Hence, when carrying out the fast-forward or rewind operation in the conventional document read-out apparatus, there were problems in that the user must carry out the troublesome operation of manually stopping the document read-out, making the fast-forward or rewind to the specified position, and then resuming the read-out from the specified position.

In addition, in the conventional document read-out apparatus, a so-called skip is made during the fast-forward and rewind operations, and the document is not read out during this skip. For this reason, there was also a problem in that it is impossible to know the contents of the document during the fast-forward and rewind operations due to the skip.

SUMMARY OF THE INVENTION

Accordingly, it is a general object of the present invention to provide a novel and useful document read-out apparatus and method and computer-readable storage medium, in which the problems described above are eliminated.

Another and more specific object of the present invention is to provide a document read-out apparatus and method and computer-readable storage medium, which can read out a document even during a fast-forward or rewind operation to an arbitrary position in the document, and can automatically read out the document after the fast-forward or rewind operation.

Still another object of the present invention is to provide a document read-out apparatus having a document read-out function for reading out a document according to a first speech parameter, comprising a first specifying section which specifies a keyword, and a read-out section which reads out the document according to a second speech parameter different from the first speech parameter, until a keyword within the document. According to the document read-out apparatus of the present invention, it is possible to read out a document even during a fast-forward or rewind operation to an arbitrary position in the document, and to automatically read out the document after the fast-forward or rewind operation.

A further object of the present invention is to provide a document read-out method which uses a document read-out function for reading out a document according to a first speech parameter, comprising the steps of (a) specifying a keyword, and (b) reading out the document according to a second speech parameter different from the first speech parameter, until a keyword within the document. According to the document read-out method of the present invention, it is possible to read out a document even during a fast-forward or rewind operation to an arbitrary position in the document, and to automatically read out the document after the fast-forward or rewind operation.

Another object of the present invention is to provide a computer-readable storage medium which stores a document read-out program for causing a computer to read out a document according to a first speech parameter, where the document read-out program comprises a first specifying procedure which causes the computer to specify a keyword, and a read-out procedure which causes the computer to read out the document according to a second speech parameter different from the first speech parameter, until a keyword within the document. According to the computer-readable storage medium of the present invention, it is possible to read out a document even during a fast-forward or rewind operation to an arbitrary position in the document, and to automatically read out the document after the fast-forward or rewind operation.

Other objects and further features of the present invention will be apparent from the following detailed description when read in conjunction with the accompanying drawings.

DESCRIPTION OF THE PREFERRED EMBODIMENTS

Figure 1:
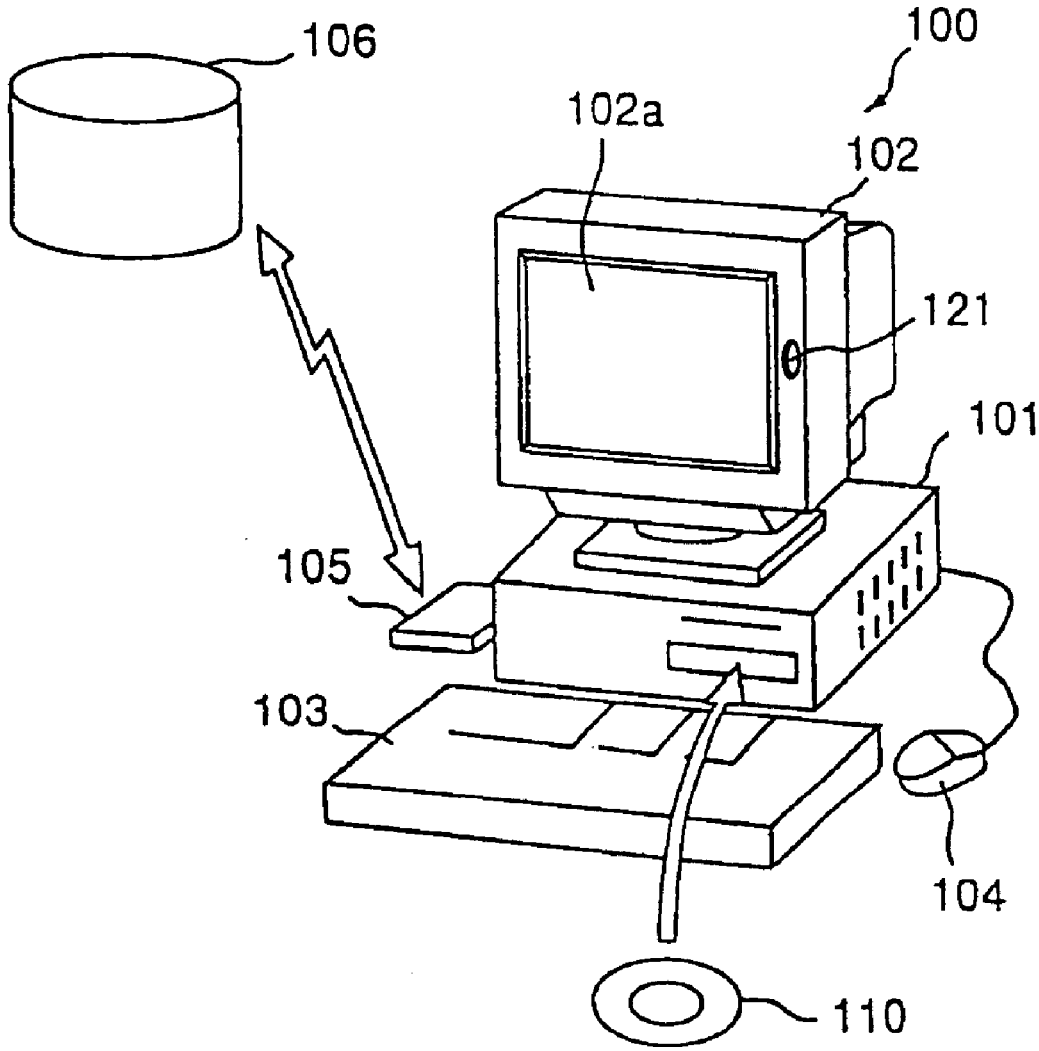
FIG. 1 is a perspective view showing a computer system applied with an embodiment of the present invention.

A description will be given of various embodiments of a document read-out apparatus, a document read-out method and a computer-readable storage medium according to the present invention, by referring to the drawings.

First, a description will be given of an embodiment of a document read-out apparatus according to the present invention. This embodiment of the document read-out apparatus employs an embodiment of a document read-out method according to the present invention. In this embodiment, the present invention is applied to a computer system. FIG. 1 is a perspective view showing a computer system which is applied with this embodiment of the present invention.

A computer system 100 shown in FIG. 1 is generally provided with a main body 101 which includes a CPU, a disk drive and the like, a display 102 which includes a display screen 102*a* for displaying an image in response to an instruction from the main body 101, a keyboard 103 which is used to input various information to the computer system 100, a mouse 104 which is used to specify an arbitrary position on the display screen 102*a* of the display 102, a modem 105 which is used to access an external database or the like and to download programs or the like stored in another computer system, and one or more speakers 121 for reproducing speech.

A document read-out program (or a document read-out software) which causes the computer system 100 to have a document read-out function is stored in a portable recording medium such as a disk 110 or, is downloaded from a recording medium 106 of another computer system using a communication unit such as the modem 105. The computer-readable storage medium according to the present invention is formed by a recording medium, such as the disk 110, which stores the document read-out program. The recording medium forming the computer-readable storage medium according to the present invention is not limited to portable recording media such as the disk 110, IC card memory, floppy disk, magneto-optical disk and CD-ROM, but also includes various kinds of recording media which are accessible by a computer system which is coupled via the communication unit or communication means such as the modem 105 and LAN.

Figure 2:
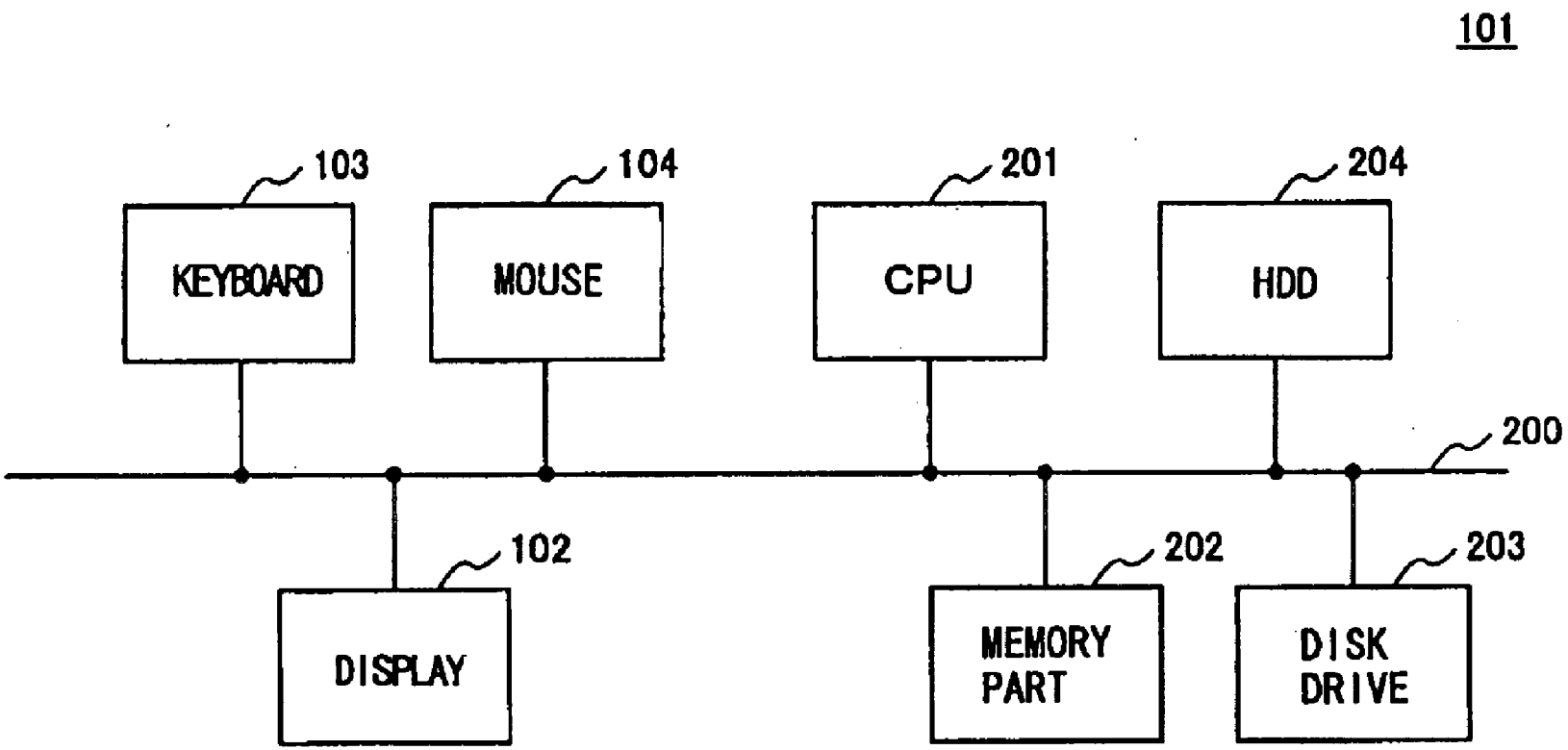
FIG. 2 is a system block diagram for explaining a construction of an important part within a main body of the computer system.

FIG. 2 is a system block diagram for explaining the structure of an important part within the main body 101 of the computer system 100. In FIG. 2, the main body 101 generally includes a CPU 201, a memory part 202 made of RAM, ROM or the like, a disk drive 203 for the disk 110, and a hard disk drive (HDD) 204 which are connected via a bus 200. The display 102, the keyboard 103, the mouse 104 and the like may be connected to the CPU 201 via the bus 200 as shown in FIG. 2 or, connected directly to the CPU 201. It is also possible to connect the display 102 to the CPU 201 via a known graphic interface (not shown) which carries out an input/output image data processing.

Of course, the structure of the computer system 100 is not limited to that shown in FIGS. 1 and 2, and various other known structures may be used instead.

Figure 3:
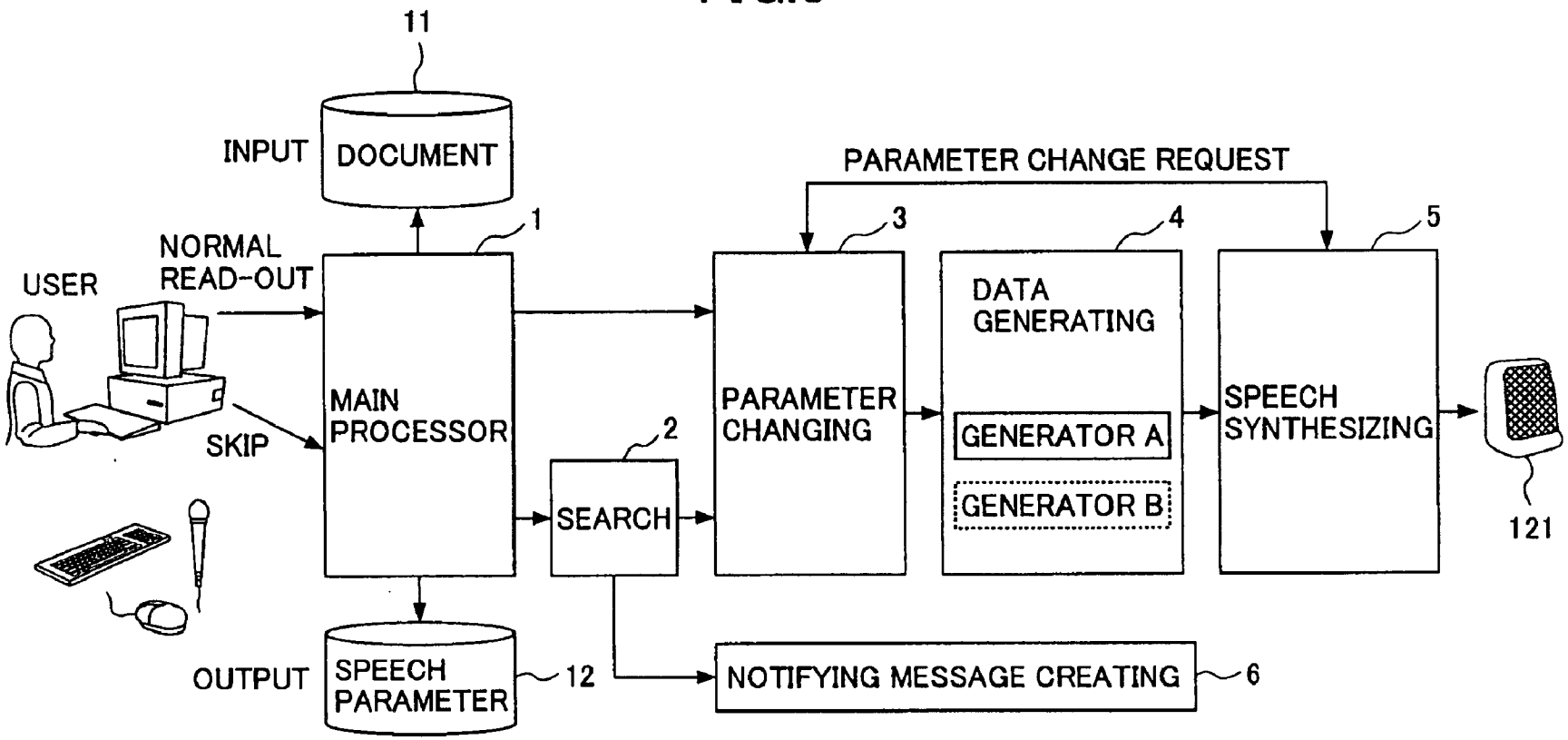
FIG. 3 is a functional block diagram for explaining an operation of a document read-out apparatus.

FIG. 3 is a functional block diagram for explaining an operation of this embodiment of the document read-out apparatus. The document read-out apparatus generally includes a main processor 1, a search section 2, a parameter changing section 3, a data generating section 4, a speech synthesizing section 5, a notifying message creating section 6, a document storage section 11, a speech parameter storage section 12, and a speaker 121. The main processor 1, the searching section 2, the parameter changing section 3, the data generating section 4, the speech synthesizing section 5 and the notifying message creating section 6 correspond to the CPU 201. On the other hand, the document storage section 11 and the speech parameter storage section 12 correspond to storage units such as the memory part 202, the disk drive 203 and the HDD 204.

In this embodiment, the document read-out apparatus includes the speech synthesizing section 5, but the speech synthesizing section 5 does not necessarily have to be a part of the document read-out apparatus. For example, in a case where the computer system 100 is provided with a known speech synthesizing function (speech synthesizing software), it is possible to use this known speech synthesizing function in place of the speech synthesizing section 5. In other words, it is sufficient as long as the document read-out apparatus can link with the internal speech synthesizing function within the document read-out software or the external speech synthesizing function to carry out a speech synthesizing process with respect to the generated speech data.

Figure 4:
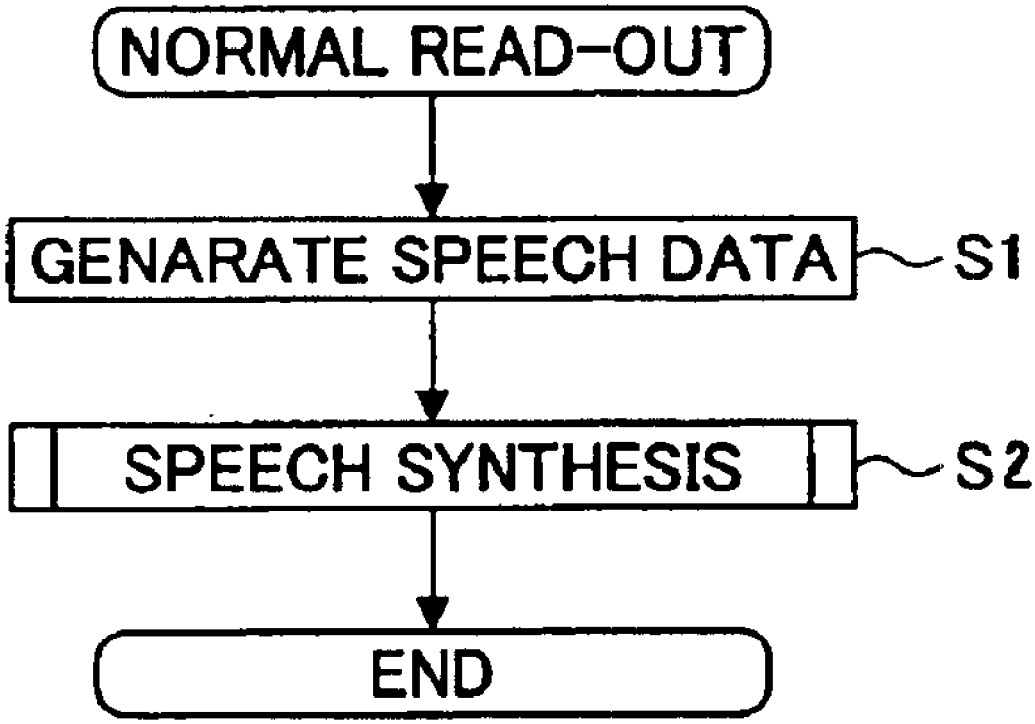
FIG. 4 is a flow chart for explaining a normal read-out process.
Figure 5:
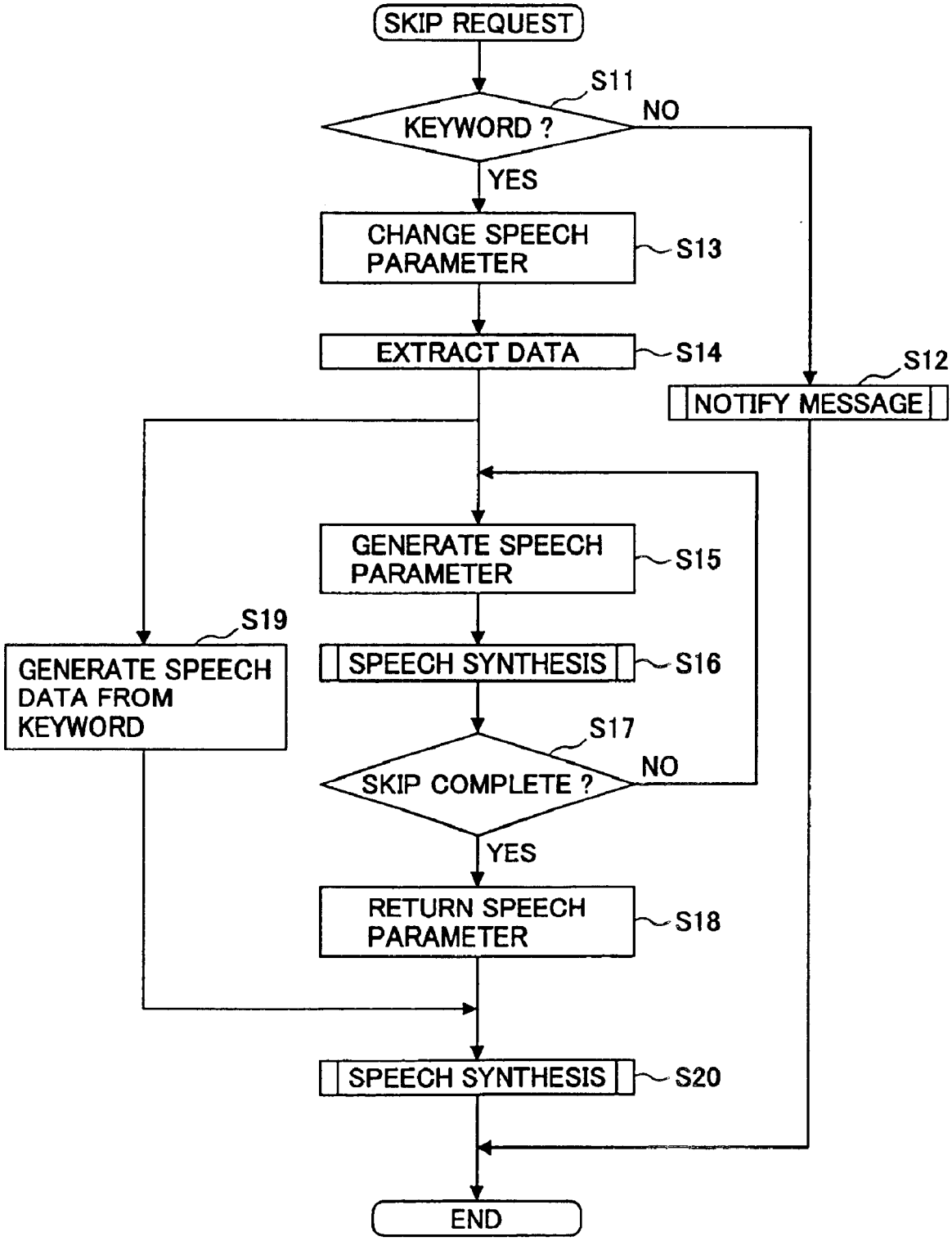
FIG. 5 is a flow chart for explaining a skip process.

In this embodiment, it is assumed for the sake of convenience that a document which is to be read out is stored in the document storage section 11 and speech parameters which will be described later are stored in the speech parameter storage section 12. When the user instructs a normal read-out process by a normal read-out instruction, a process shown in FIG. 4 is carried out. On the other hand, when the user instructs a skip process by a skip instruction, a process shown in FIG. 5 is carried out. The normal read-out process and the skip process can be instructed from the user by the normal read-out instruction and the skip instruction, respectively, by use of an input device such as the keyboard 103 and the mouse 104. Furthermore, the normal read-out process and the skip process can be instructed by speech using a known speech recognition technique, and the method of inputting such instructions is not limited to a specific method.

In the case of the normal read-out process shown in FIG. 4, a step S1 generates speech data of the document which is to be read out, depending on the normal read-out instruction from the user. In other words, the main processor 1 reads from the document storage section 11 the document which is to be read out and is specified in the normal read-out instruction. In addition, the main processor 1 reads the speech parameters from the speech parameter storage section 12, and supplies the speech parameters to the parameter changing section 3. For the sake of convenience, it is assumed that there is no speech parameter change request from the user. Accordingly, the data generating section 4 generates a corresponding speech data from the document which is obtained from the main processor 1 via the parameter changing section 3. A step S2 carries out a known speech synthesizing process based on the generated speech data and the speech parameters obtained via the parameter changing section 3, and the process ends. In this embodiment, the speech parameters include at least one of reproducing speed, volume and sound pitch. Hence, if the speech parameter is the reproducing speed, for example, the step S2 carries out the speech synthesizing process at the reproducing speed which is specified by the speech parameter, and the synthesized speech is output via the speaker 121.

In the above described case, the speech parameters used during the normal read-out process are fixed, but it is also possible to specify the speech parameters from the user. In this case, the normal read-out instruction includes, in addition to information specifying the document which is to be read out, codes or the like of the specified speech parameters. Thus, the speech parameters specified by the codes are read from the speech parameter storage section 12.

During the skip process, an interval between specified first and second positions within the document which is to be read out, is read out using speech parameters which are different from the speech parameters used during the normal read-out process. In this case, the first position is for example a present position of a cursor within the document, and the second position is for example a position where a keyword exists within the document. In this embodiment, the skip instruction includes information specifying the document which is to be read, information specifying the keyword, and information (speech parameter change request) specifying the speech parameters to be used. The speech parameters used during the skip process simply need to be different from the speech parameters used during the normal read-out process, and thus, the speech parameters used during the skip process may of course be fixed. The skip instruction may be made during the normal read-out process, that is, the keyword may be specified while the document is being read out.

In the case of the skip process shown in FIG. 5, a step S11 decides whether or not the keyword specified by the skip instruction exists within the document which is specified by the skip instruction. More particularly, the main processor 1 reads from the document storage section 11 the document which is to be read out and is specified in the skip instruction. In addition, the main processor 1 reads from the speech parameter storage section 12 the speech parameters which are specified by the skip instruction, and supplies the speech parameters to the search section 2. The search section 2 carries out a known keyword search process to judge whether or not the specified keyword is included in the document which is to be read out. The keyword search process itself may be realized by a known search function of the word processor, for example, and this known search function may be provided internally within the document read-out software or externally with respect to the document read-out software. For example, when searching the keyword by utilizing the search function which is provided in advance in the word processor, the user will not be confused by different user interfaces, and the skip to the keyword can be made using the user interface of the word processor the user is familiar with.

If the decision result in the step S11 is NO, a step S12 outputs a message to notify the user that the specified keyword was not found within the document, and the process ends. In other words, if the search section 2 cannot find the specified keyword, this is notified to the notifying message creating section 6. The notifying message creating section 6 creates a message indicating "Keyword was not found.", for example, and this message is displayed on the display 102 or output by speech via the speaker 121.

On the other hand, if the decision result in the step S11 is YES, a step S13 changes the speech parameters which are used during the normal read-out process to the speech parameters (speech parameter change request) included in the skip instruction. In other words, the parameter changing section 3 changes the speech parameters which are used during the normal read-out process to the specified speech parameters when notified from the search section 2 that the specified keyword was found within the document. For the sake of convenience, it is assumed that the speech parameters after the change indicates a reproducing speed which is faster than the reproducing speed used during the normal read-out process. A step S14 extracts, from the data read from the document storage section 11, the document portion data from the present reproducing position within the document to the position of the keyword within the document. This extraction of the document portion data is carried out by the data generating section 4.

After the step S14, a process made up of steps S15 through S18 and a process made up of a step S19 are carried out in parallel.

The step S15 generates the speech data of the document portion data which is to be skipped. The step S16 carries out a speech synthesis with respect to the speech data generated from the speech synthesizing section 5 based on the speech parameters after the change, and the synthesized speech is output via the speaker 121. The step S17 decides whether or not the skip is completed, and the process returns to the step S15 if the decision result in the step S17 is NO. On the other hand, if the decision result in the step S17 is YES, the step S18 returns the speech parameters after the change back to the speech parameters used during the normal read-out process, and the process advances to a step which will be described later.

The step S19 generates the speech data of the document portion from the keyword and after, by the data generating section 4, and the process advances to the step S20. Accordingly, the step S20 carries out the speech synthesis of the speech data of the document portion from the keyword and after, by the speech synthesizing section 5, based on the speech parameters before the change, to thereby output the synthesized speech via the speaker 121. The process ends after the step S20. Therefore, during the skip process which skips the document until the specified keyword, the generation of the speech data of the document portion including and after the keyword is carried out in advance, at least in part. For this reason, a continuity is maintained between the speech synthesized during the skip process and the speech synthesized during the normal read-out process from the keyword and after, and no unnatural wait time or the like is generated before and after the keyword.

Figure 6:
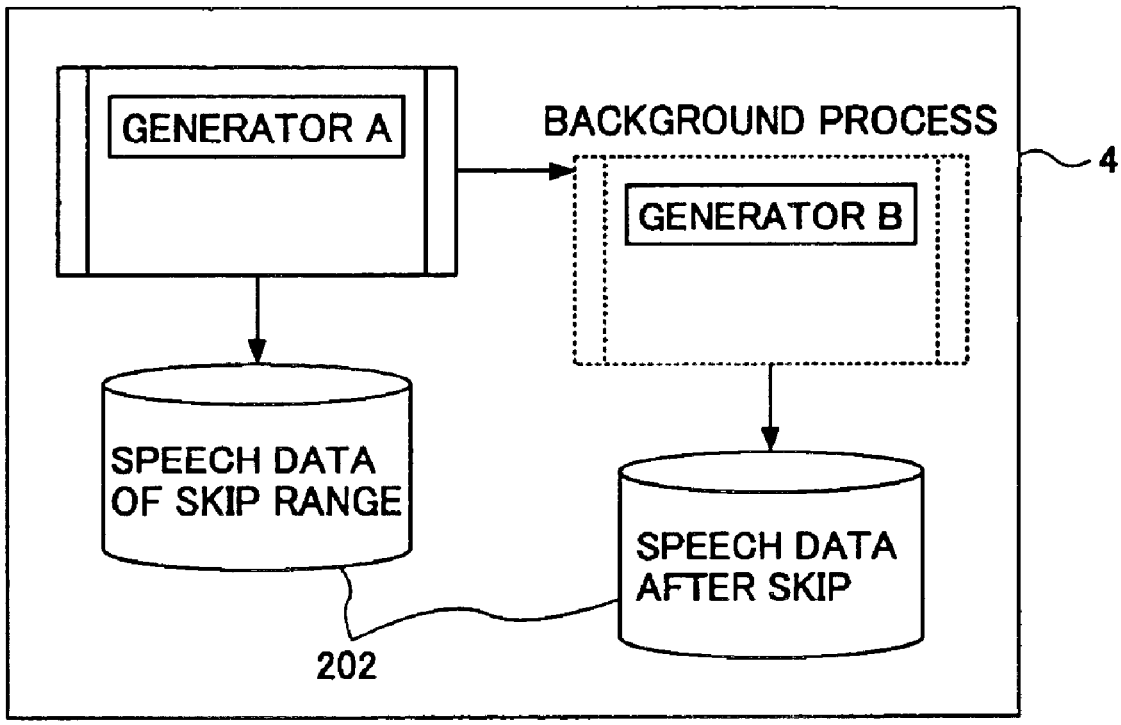
FIG. 6 is a diagram for explaining an operation of a data generating section.

FIG. 6 is a diagram for explaining an operation of the data generating section 4. As shown in FIG. 6, the data generating section 4 includes generators A and B. The generator A extracts the data within a skip range from the present reproducing position within the document to the position of the keyword within the document, from the data read from the document storage section 11, and temporarily stores the data within the skip range into the memory part 202, for example. Furthermore, the generator A starts the generator B which carries out a background process. The generator B generates the speech data of the document portion from the keyword and after, and temporarily stores the speech data into the memory part 202, for example. Accordingly, the generator B generates at least a part of the speech data after the skip in parallel with the generation of the speech data within the skip range by the generator A, and it is possible to smoothly connect the speech which is synthesized before and after the skip process.

In a case where the keyword exists at a position preceding the present position within the document, the skip process becomes a rewind operation. On the other hand, the skip process becomes a fast-forward operation in a case where the keyword exists at a position subsequent to the present position within the document. In addition, since the speech parameter is the reproducing speed and the reproducing speed during the skip process is set faster than the reproducing speed during the normal read process in this embodiment, the speech synthesis during the rewind and fast-forward operations is carried out at a reproducing speed which is faster than the reproducing speed during the normal read process.

If is possible to take measures so that, when the user makes a speech parameter change request during the normal read process, the document read-out is made based on the speech parameters which are specified by the speech parameter change request.

Figure 7:
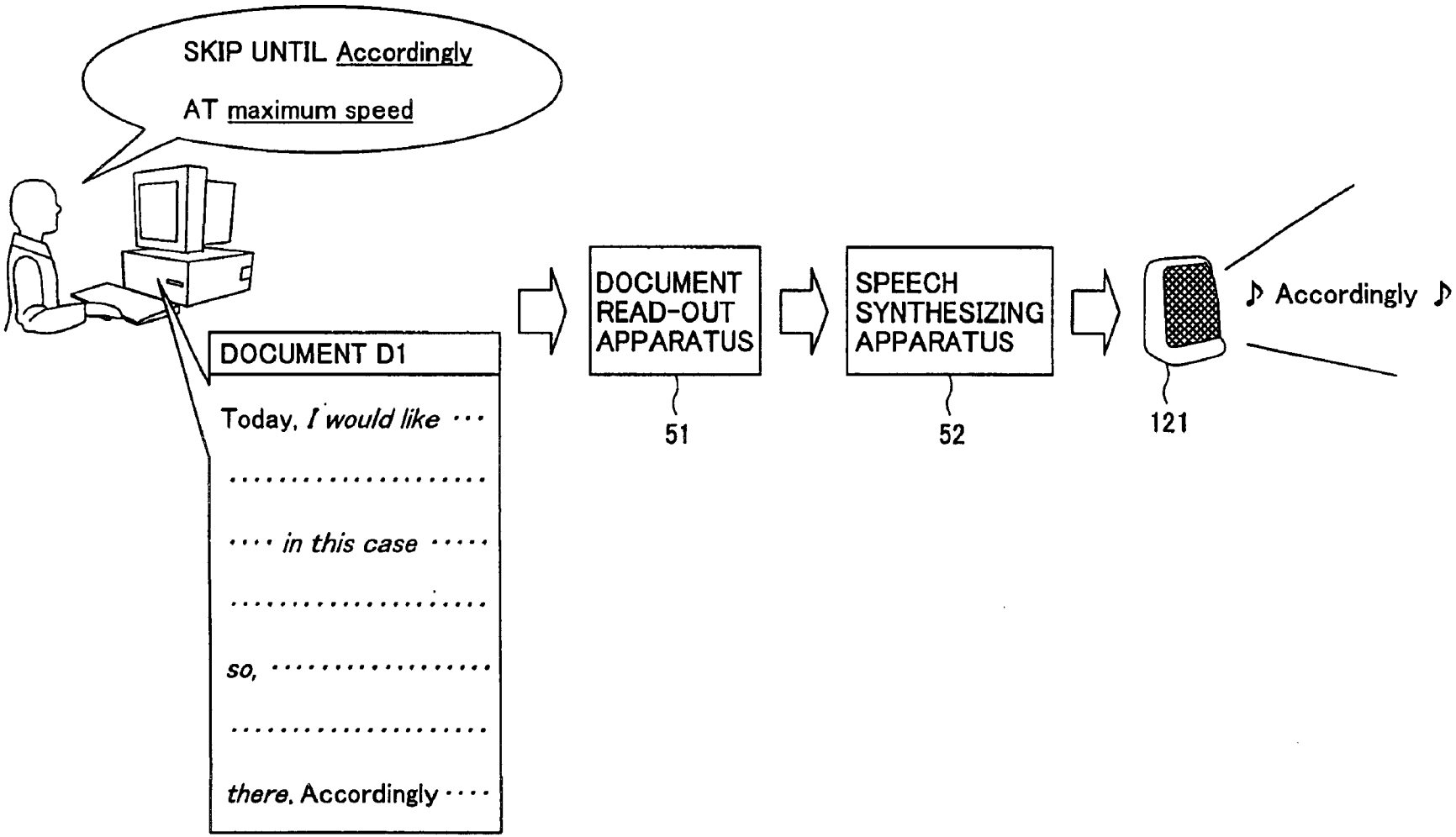
FIG. 7 is a diagram for explaining a particular skip process.

FIG. 7 is a diagram for explaining a particular skip process. In this particular skip process, it is assumed for the sake of convenience that the skip process is carried out at a reproducing speed which is set to a maximum speed until a keyword "Accordingly" within a document D1. Moreover, it is assumed that a document read-out apparatus 51 according to the present invention and a speech synthesizing apparatus 52 are independent. In other words, it is assumed that the document read-out software and the speech synthesizing function (software) are independent. If the present position within the document D1 is "Today", a document portion indicated by italics is skipped.

Figures 8, 9:
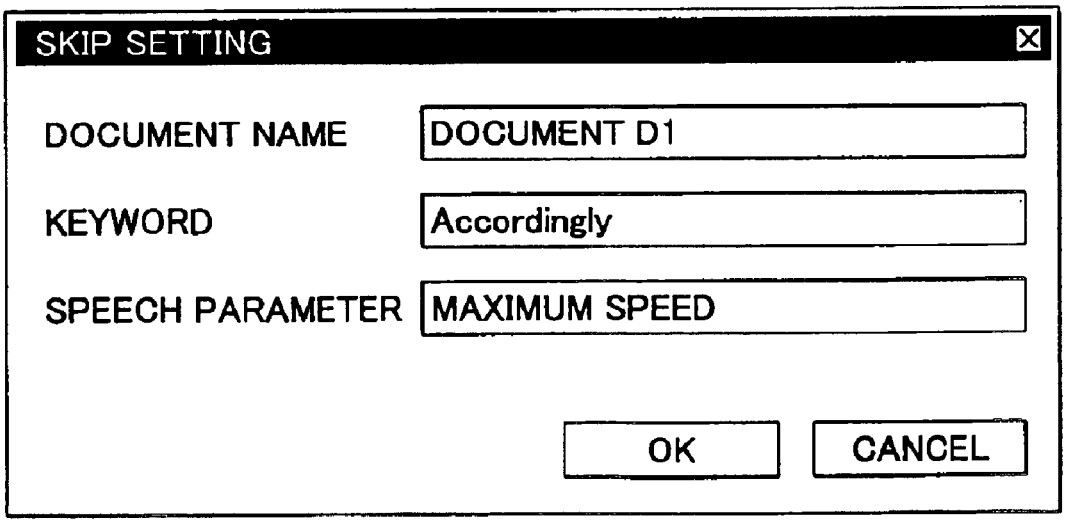
FIG. 8 is a diagram showing registered speech parameters.
FIG. 9 is a diagram showing a skip setting menu.

FIG. 8 is a diagram showing registered speech parameters. The speech parameter storage section 12 shown in FIG. 13 stores the speech parameters such as those shown in FIG. 8, and arbitrary speech parameters may be registered and specified by the user. Accordingly, in a case where the speech parameter (reproducing speed) during the normal read process is set to "7" which indicates "normal speed", and the speech parameter (reproducing speed) during the skip process is set to "9" which indicates "maximum speed", a portion "Today" of the document D1 is read out at the "normal speed", and a portion "I would . . . " until the keyword "Accordingly" is read out at the "maximum speed", and a portion from the keyword "Accordingly" and after is read out again at the "normal speed".

FIG. 9 is a diagram showing a skip setting menu which is displayed on the display 102 when the user makes a skip instruction. In the skip setting menu shown in FIG. 9, a document name, a keyword and a speech parameter can be input by the user. FIG. 9 shows a particular case where the user makes the input from the keyboard 103, and inputs "document D1" as the document name, "Accordingly" as the keyword, and "maximum speed" (or "9") as the speech parameter. When the user completes the input on the skip setting menu, the user selects an "OK" button in the skip setting menu using a click of the mouse 104, and the operation of inputting the skip instruction ends.

Of course, the keyword may consist of a single letter, including alphanumeric characters, punctuation marks and symbols. In addition, the keyword does not necessarily have to consist of a single word! and may be made up of a group of words, such as "by the way", and "of course".

Further, the present invention is not limited to these embodiments, but various variations and modifications may be made without departing from the scope of the present invention.

What is claimed is:

1. A document read-out apparatus having a document read-out function for reading out a document according to a first speech parameter, comprising:

a first specifying section configured to specify a keyword; and a read-out section configured to read out the document according to a second speech parameter which is variable and is different from the first speech parameter, until a keyword within the document.

2. The document read-out apparatus as claimed in claim 1, wherein the first and second speech parameters respectively include at least one parameter selected from a group of a reproducing speed, volume and sound pitch.

3. The document read-out apparatus as claimed in claim 1, further comprising:

a second specifying section configured to variably specify the second speech parameter.

4. The document read-out apparatus as claimed in claim 1, further comprising:

a section configured to carry out in advance at least a part of a speech data generating process with respect to the document for a document portion from the specified keyword and after, while the document is read out until the specified keyword; and a section configured to read out the document portion from the specified keyword and after according to the first speech parameter, based on a result of the speech data generating process which is carried out in advance.

5. The document read-out apparatus as claimed in claim 1, wherein said read-out section carries out a speech synthesizing process which is included in the document read-out function or is independent of the document read-out function.

6. The document read-out apparatus as claimed in claim 1, wherein:

said first specifying section enables a keyword to be specified while the document is being read out according to the first speech parameter; and said read-out section reads out the document according to the second speech parameter until the keyword which is specified while the document is being read out.

7. The document read-out apparatus as claimed in claim 1, further comprising:

a second specifying section configured to variably specify the second speech parameter with respect to the document while the document is being read out.

8. A document read-out method which uses a document read-out function for reading out a document according to a first speech parameter, comprising the steps of:

(a) specifying a keyword; and (b) reading out the document according to a second speech parameter which is variable and is different from the first speech parameter, until a keyword within the document.

9. The document read-out method as claimed in claim 8, further comprising the step of:

(c) variably specifying the second speech parameter.

10. The document read-out method as claimed in claim 8, further comprising the steps of:

(c) carrying out in advance at least a part of a speech data generating process with respect to the document for a document portion from the specified keyword and after, while the document is read out until the specified keyword; and (d) reading out the document portion from the specified keyword and after according to the first speech parameter, based on a result of the speech data generating process which is carried out in advance.

11. The document read-out method as claimed in claim 8, wherein said step (b) carries out a speech synthesizing process which is included in the document read-out function or is independent of the document read-out function.

12. The document read-out method as claimed in claim 8, wherein:

said step (a) enables a keyword to be specified while the document is being read out according to the first speech parameter; and said step (b) reads out the document according to the second speech parameter until the keyword which is specified while the document is being read out.

13. The document read-out method as claimed in claim 8, wherein the first and second speech parameters respectively include at least one parameter selected from a group of a reproducing speed, volume and sound pitch.

14. The document read-out apparatus as claimed in claim 8, further comprising the steps of:

(c) variably specifying the second speech parameter with respect to the document while the document is being read out.

15. A computer-readable storage medium which stores a document read-out program for causing a computer to read out a document according to a first speech parameter, said document read-out program comprising:

a first specifying procedure which causes the computer to specify a keyword; and a read-out procedure which causes the computer to read out the document according to a second speech parameter which is variable and is different from the first speech parameter, until a keyword within the document.

16. The computer-readable storage medium as claimed in claim 15, said document read-out program further comprising:

a procedure which causes the computer to carry out in advance at least a part of a speech data generating process with respect to the document for a document portion from the specified keyword and after, while the document is read out until the specified keyword; and a procedure which causes the computer to read out the document portion from the specified keyword and after according to the first speech parameter, based on a result of the speech data generating process which is carried out in advance.

17. The computer-readable storage medium as claimed in claim 15, wherein said read-out procedure links to a speech synthesizing procedure which is included in the document read-out program or is independent of the document read-out program.

18. The computer-readable storage medium as claimed in claim 15, wherein:

said first specifying procedure enables the computer to specify a keyword while the document is being read out according to the first speech parameter; and said read-out procedure causes the computer to read out the document according to the second speech parameter until the keyword which is specified while the document is being read out.

19. The computer-readable storage medium as claimed in claim 15, wherein the first and second speech parameters respectively include at least one parameter selected from a group of a reproducing speed, volume and sound pitch.

20. The computer-readable storage medium as claimed in claim 15, said document read-out program further comprising:

a second specifying procedure which causes the computer to variably specify the second speech parameter.

21. The computer-readable storage medium as claimed in claim 15, said document read-out program further comprising:

a second specifying procedure which causes the computer to variably specify the second speech parameter with respect to the document while the document is being read out.

* * * * *